US005638835A

United States Patent [19]

Franz et al.

[11] Patent Number: 5,638,835

[45] Date of Patent: Jun. 17, 1997

[54] POROUS ARTIFICIAL NAIL

[76] Inventors: JoAnn Franz, 22350 Statler, St. Clair Shores, Mich. 48081; Rudolph Liedtke, 1004 Yorkshire, Grosse Pointe Park, Mich. 48230

[21] Appl. No.: 509,173

[22] Filed: Jul. 31, 1995

[51] Int. Cl.[6] ..... A45D 24/00

[52] U.S. Cl. ..... 132/200; 132/73; 132/319; 132/76.4

[58] Field of Search ..... 132/73, 319, 76.4, 132/200

[56] References Cited

U.S. PATENT DOCUMENTS

| | | | |
|---|---|---|---|
| 2,941,535 | 6/1960 | Lappe | 132/73 |
| 4,346,720 | 8/1982 | Hokama . | |
| 4,554,935 | 11/1985 | Hokama . | |
| 4,596,260 | 6/1986 | Giuliano | 132/73 |
| 4,627,453 | 12/1986 | Isler . | |
| 4,632,134 | 12/1986 | Reid . | |
| 4,751,935 | 6/1988 | Mast et al. | 132/73 |
| 4,761,232 | 8/1988 | Bright . | |
| 4,913,173 | 4/1990 | Hokama et al. . | |
| 5,219,645 | 6/1993 | Schoon . | |

*Primary Examiner*—Gene Mancene
*Assistant Examiner*—Pedro Philogene
*Attorney, Agent, or Firm*—Young & Basile, PC

[57] ABSTRACT

An artificial fingernail/extension for attachment to a natural fingernail having an upper surface. The artificial nail comprises a flexible polymeric body having an upper surface and a lower surface, the lower surface contacting the natural fingernail upper surface. The body is sized to provide a forward extension from the natural fingernail. The artificial fingernail further comprises a plurality of pores dispersed throughout the body, the pores adapted to quickly wick liquid adhesive throughout the body, from the body upper surface toward the body lower surface, wherein the adhesive contacts substantially the entire upper fingernail surface in contact with the body lower surface to form an integral bond therebetween. A method for applying an artificial fingernail/extension onto a natural fingernail having an upper surface comprises the step of applying an amount of liquid adhesive onto the porous body upper surface, wherein the amount of adhesive applied is sufficient to contact substantially the entire upper fingernail surface in contact with the body lower surface to form an integral bond therebetween.

15 Claims, 1 Drawing Sheet

POROUS ARTIFICIAL NAIL

BACKGROUND OF THE INVENTION

The present invention relates generally to a polymeric material suitable for use on human fingernails, and more particularly to such a material which is porous and able to support an integrated bond between it and the natural fingernail.

Various artificial fingernail compositions have been proposed for use as cosmetic applications. Popular among these are acrylic nails, linen or silk applications, and fiberglass. To these are applied nail polish basecoats, colored/clear nail polish such as enamels, and/or nail polish topcoats. In general, these nail compositions are applied to the surfaces of nails to beautify the nails and hands. The reason many women choose artificial nails and/or extensions is to strengthen the natural nail and make it more durable, thereby reducing the possibility of breakage. Since the artificial nails and/or extensions are much stronger than natural nails, the coated film of nail enamel is virtually free from damage such as chipping and peeling.

However, these artificial nails and/or extensions are themselves not free from problems. Conventionally, these products are adhesively applied directly onto the majority of the upper exposed surface of the human fingernail. In doing this, often air pockets form between the artificial nail/extension and the human fingernail. These air pockets cause the artificial nail to lift off the surface of the natural fingernail. This is aesthetically displeasing and annoying to the wearer and must immediately be repaired by a manicurist or nail technician. Further, if the artificial nail remains on with the air pockets captured therebetween, the problem may be more serious than an aesthetic one—bacteria and fungus can collect in the air collect in the air pockets, thereby risking damage to the natural nail and/or cuticle.

Several solutions have heretofore been posed. Among these is U.S. Pat. No. 4,554,935 issued to Hokama. This patent discloses an artificial nail with holes for receiving liquid adhesive, having as its object to provide better locking to the human nail. However, problems have been encountered with this solution. Hokama discloses a head formed from cured adhesive, akin to a rivet head, extending beyond the holes to help provide the locking and prevent air pockets. However, as stated above, time is of the essence, and it is likely that the manicurist will not have the time and/or be able to locate the adhesive heads while finishing the nail (removing ridges, smoothing and preparing the surface, etc.) by filing. As such, the adhesive heads will most likely become filed away, thereby not achieving the inventor's objective. Further, even if the heads remain, they may not satisfactorily prevent the formation of air pockets in areas remote from the holes.

Thus, it is an object of the present invention to provide an artificial nail and/or extension which promotes a substantially fully integrated bond between the artificial nail and the human fingernail, thereby advantageously helping to prevent nail "lift-off" and/or pockets of bacteria or infection. It is a further object of the present invention to provide such an artificial nail which is easy to manipulate and can be correctly applied quickly and efficiently, thus saving both the manicurist and the customer from an excess of time and/or distress.

SUMMARY OF THE INVENTION

The present invention, in achieving the objects recited hereinabove, addresses and solves the enumerated problems.

The present invention comprises an artificial fingernail/extension for attachment to a natural fingernail having an upper surface. The artificial nail comprises a flexible polymeric body having an upper surface and a lower surface, the lower surface contacting the natural fingernail upper surface. The body is sized to provide a forward extension from the natural fingernail. The artificial fingernail further comprises a plurality of pores dispersed throughout the body, the pores adapted to quickly wick liquid adhesive throughout the body, from the body upper surface toward the body lower surface, wherein the adhesive contacts substantially the entire upper fingernail surface in contact with the body lower surface to form an integral bond therebetween.

A method for applying an artificial fingernail/extension onto a natural fingernail having an upper surface comprises the step of applying an amount of liquid adhesive onto the porous body upper surface, wherein the amount of adhesive applied is sufficient to contact substantially the entire upper fingernail surface in contact with the body lower surface to form an integral bond therebetween.

BRIEF DESCRIPTION OF THE DRAWINGS

Other objects, features and advantages of the present invention will become apparent by reference to the following detailed description and drawings, in which.

DETAILED DESCRIPTION OF THE PREFERRED EMBODIMENTS

Figure 1:
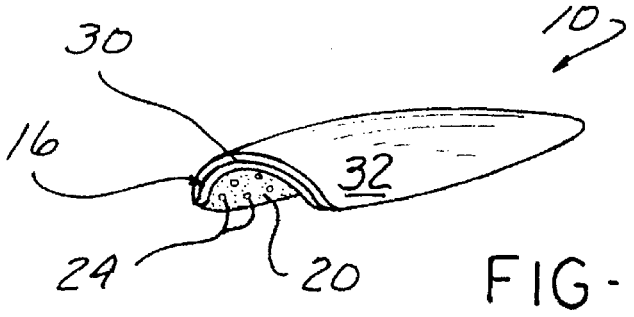
FIG. 1 is a perspective view of the artificial fingernail/extension of the present invention, showing subsequent laminate applied thereon.

Referring now to FIG. 1, the artificial nail/extension of the present invention is designated generally as 10. Artificial fingernail/extension 10 is for attachment to a natural fingernail 12 having an upper surface 14. The artificial nail comprises a flexible polymeric body 16 having an upper surface 18 and a lower surface 20, the lower surface 20 contacting the natural fingernail upper surface 14. The body 16 is sized to provide a forward extension 22 from the natural fingernail 12.

Figure 2:
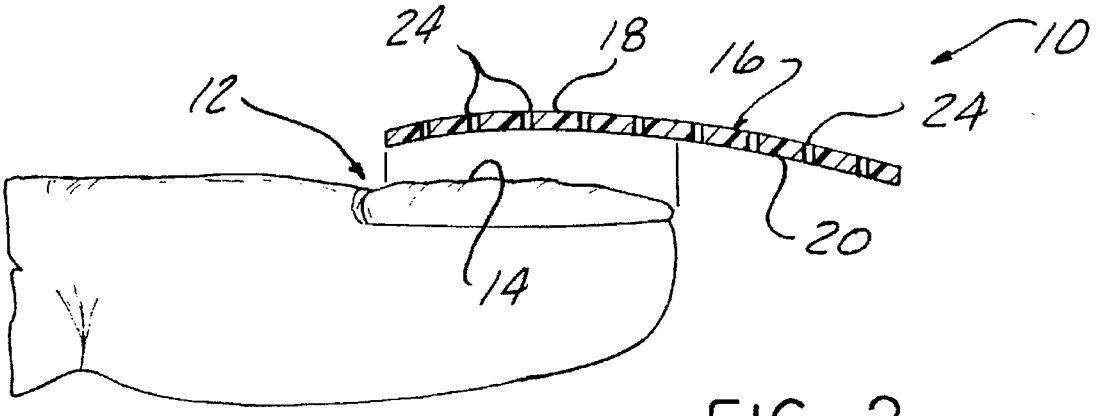
FIG. 2 is a cutaway, exploded cross sectional view of the present invention, showing some exemplary pores.

The nail/extension 10 may further comprise a plurality of pores 24 dispersed throughout body 16, the pores 24 adapted to quickly wick liquid adhesive (not shown) throughout the body 16, from the body upper surface 18 to the body lower surface 20, wherein the adhesive contacts substantially the entire upper fingernail surface 14 which is in contact with the body lower surface 20. This forms an integral bond therebetween. It is to be understood that the pores 24 may be of any suitable size, however, in the preferred embodiment, the pores 24 range in size between about 20 microns and about 100 microns with about 30% to about 70% void space therebetween. In FIGS. 1 and 2, pores 24 have been shown greatly exaggerated in size for illustrative purposes.

It is to be understood that the body 16 may have any suitable thickness as desired and/or necessary. However, in the preferred embodiment, the body 16 has a thickness ranging between about 0.015 inch and about 0.035 inch. Still more preferred, the body 16 has a thickness ranging between about 0.022 inch and about 0.028 inch. It is to be further understood that the body 16 may be formed from any suitable polymeric material; however, in the preferred embodiment, body 16 is formed from a hydrophilic, high density polyethylene (HDPE). One such suitable polymeric material is commercially available from Porex Technologies Corporation in Fairburn, Ga. under the designation Model X-4588. This material is distributed in nominal width of 12 inches in 100 ft. rolls. One side of the sheet is smooth with a plastic feel, while the other side is rough with a coarse feel. A 1.0 inch disc sample size of this material absorbs 1 drop of colored water in fewer than 10 seconds.

Figure 3:
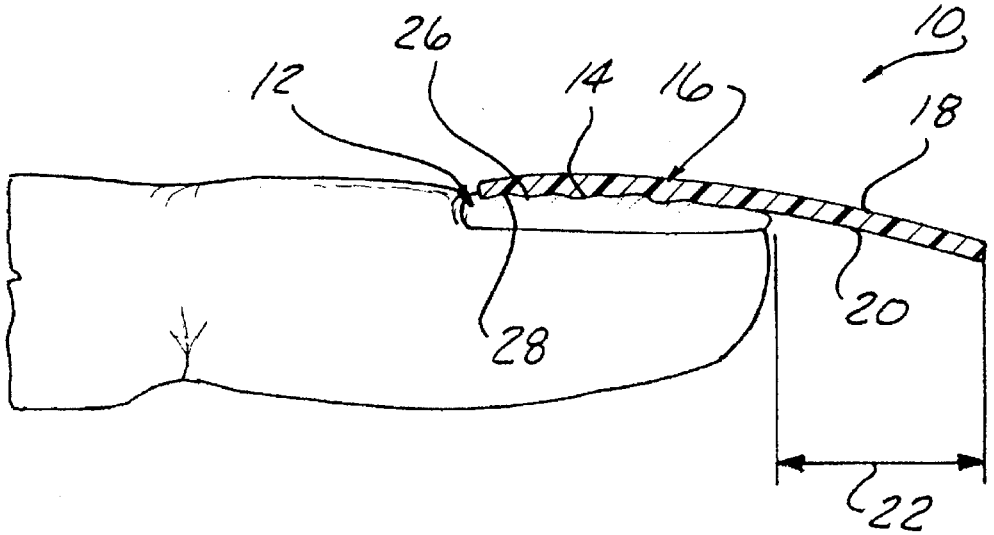
FIG. 3 is a cutaway cross sectional view showing the flexible body closely conforming to natural ridges and valleys.

As shown in FIG. 3, body 16 is flexibly conformable to the upper surface 14 of the natural fingernail 12. This is illustrated in that the natural fingernail upper surface 14 has a plurality of ridges 26 with valleys 28 therebetween. Flexible body 16 conforms to the ridges 26 and the valleys 28.

A method for applying artificial fingernail/extension 10 onto natural fingernail 12 comprises the step of applying an amount of liquid adhesive onto upper surface 18 of flexible polymeric body 16, a portion of the lower surface 20 contacting the natural fingernail upper surface 14, the body 16 sized to provide a forward extension 22 from the natural fingernail 12, the body 16 having a plurality of pores 24 dispersed therethrough, the pores 24 adapted to quickly wick the liquid adhesive throughout the body 16, from the body upper surface 18 toward the body lower surface 20, wherein the amount of adhesive applied is sufficient to contact substantially the entire upper fingernail surface 14 in contact with the body lower surface 20 to form an integral bond therebetween.

The manicurist may position further liquid adhesive on that portion of the upper surface 18 corresponding to the forward extending portion 22 of body 16 in order to harden the extending portion 22 for forming with a scissors and/or nail file before laminates 30, 32 are applied-liquid adhesive will quickly disperse throughout the polymeric body 16 with small spot applications, thereby providing further hardening to the artificial fingernail/extension 10, and contributing to the integral bond between the body lower surface 20 and the upper fingernail surface 14.

The method may further comprise the step of filing the upper surface 18 of the adhesively attached body 16. This may remove any ridges formed between the artificial nail 10 and fingernail 12, and may also prepare the surface 18 for further applications 30 such as acrylics, linen, silk, bonded fiberglass, and the like as generally known in the art. If desired, to these applications 30 may be applied one or more layers of nail polish 32.

To further illustrate the present invention, the following exemplary methods are given. It is to be understood that these exemplary methods are provided for illustrative purposes and are not to be construed as limiting the scope of the present invention.

For a free-formed nail extension, the flexible porous material 16 may be cut into suitably manageable lengths. One example of such a size is ½" by 6". The material 16 is easily cut by scissors or paper cutters. The smooth side of the flexible material (preferably, although the rough side may also suitably be placed in contact with the natural nail 12) is sprayed with a glue accelerator. The portion of the flexible material 16 which will contact the natural nail 12 is curled with the tip of a scissors, somewhat like curling a ribbon, thereby making the material even more conformable to the radius of curvature of the nail 12. To the curled portion which will contact the nail 12, a drop of suitable nail glue, such as ethyl-2-cyanoacrylate combined with 0 to 1.0 percent hydroquinone, is applied, and the flexible material 16 is put in place on the nail 12. The material bonds very quickly. Any excess porous material 16 may be cut off, and the artificial nail 10 may be contoured to any suitable shape and/or length. The nail 10 leaves a ridge of approximately 0.025 inch. This may be blended with the nail 12 by appropriate filing.

The porous flexible body 16 may also be die cut to create pre-formed nail tips with a radius that conforms to natural nails 12. It 16 may also be curved downward from tip to end to appear more like a real nail 12. It is also possible that these pre-formed nails may be formed by casting or any other suitable molding processes.

While preferred embodiments of the invention have been described in detail, it will be apparent to those skilled in the art that the disclosed embodiments may be modified. Therefore, the foregoing description is to be considered exemplary rather than limiting, and the true scope of the invention is that defined in the following claims.

What is claimed is:

1. An artificial fingernail/extension for attachment to a natural fingernail having an upper surface, the artificial nail comprising:

a flexible polymeric body having an upper surface and a lower surface, the lower surface contacting the natural fingernail upper surface, wherein the body is flexibly conformable to the upper surface of the natural fingernail, and wherein the body is sized to provide a forward extension from the natural fingernail; and a plurality of pores dispersed throughout the body, the pores adapted to quickly wick liquid adhesive throughout the body, from the body upper surface to the body lower surface, wherein the adhesive contacts substantially the entire upper fingernail surface in contact with the body lower surface to form an integral bond therebetween.

2. The artificial fingernail as defined in claim 1 wherein the pores range in size between about 20 microns and about 100 microns with about 30% to about 70% void space therebetween.

3. The artificial fingernail as defined in claim 1 wherein the body has a thickness ranging between about 0.015 inch and about 0.035 inch.

4. The artificial fingernail as defined in claim 3 wherein the body has a thickness ranging between about 0.022 inch and about 0.028 inch.

5. The artificial fingernail as defined in claim 1 wherein the body is formed from a hydrophilic, high density polyethylene.

6. The artificial fingernail as defined in claim 5 wherein the natural fingernail upper surface has a plurality of ridges with valleys therebetween, and wherein the flexible body conforms to the ridges and the valleys.

7. An artificial fingernail/extension for attachment to a natural fingernail having an upper surface, the artificial nail comprising:

a flexible polymeric body having a thickness ranging between about 0.022 inch and about 0.028 inch, and having an upper surface and a lower surface, the lower surface contacting the natural fingernail upper surface, the body sized to provide a forward extension from the natural fingernail, wherein the body is formed from a hydrophilic, high density polyethylene, and is flexibly conformable to the upper surface of the natural fingernail; and a plurality of pores dispersed throughout the body, wherein the pores range in size between about 20 microns and about 100 microns with about 30% to about 70% void space therebetween, the pores adapted to quickly wick liquid adhesive throughout the body, from the body upper surface toward the body lower surface, wherein the adhesive contacts substantially the entire upper fingernail surface in contact with the body lower surface to form an integral bond therebetween.

8. The artificial fingernail as defined in claim 7 wherein the natural fingernail upper surface has a plurality of ridges with valleys therebetween, and wherein the flexible body conforms to the ridges and the valleys.

9. A method for applying an artificial fingernail/extension onto a natural fingernail having an upper surface, the method comprising the step of:

applying an amount of liquid adhesive onto an upper surface of a flexible polymeric body also having a lower surface, the lower surface contacting the natural fingernail upper surface, wherein the body is flexibly conformable to the upper surface of the natural fingernail, the body being sized to provide a forward extension from the natural fingernail, the body having a plurality of pores dispersed therethrough, the pores adapted to quickly wick the liquid adhesive throughout the body, from the body upper surface toward the body lower surface, wherein the amount of adhesive applied is sufficient to contact substantially the entire upper fingernail surface in contact with the body lower surface to form an integral bond therebetween.

10. The method as defined in claim 9, further comprising the step of filing the upper surface of the adhesively attached body.

11. The method as defined in claim 9 wherein the pores range in size between about 20 microns and about 100 microns with about 30% to about 70% void space therebetween.

12. The method as defined in claim 9 wherein the body has a thickness ranging between about 0.015 inch and about 0.035 inch.

13. The method as defined in claim 12 wherein the body has a thickness ranging between about 0.022 inch and about 0.028 inch.

14. The method as defined in claim 9 wherein the body is formed from a hydrophilic, high density polyethylene.

15. The method as defined in claim 14 wherein the natural fingernail upper surface has a plurality of ridges with valleys therebetween, and wherein the flexible body conforms to the ridges and the valleys.

* * * * *